United States Patent [19]

Huemer

[11] Patent Number: 4,619,293

[45] Date of Patent: Oct. 28, 1986

[54] CIRCULAR LOOM

[76] Inventor: Franz X. Huemer, Sonnenuhrgasse 4, 1060 Vienna, Austria

[21] Appl. No.: 736,786

[22] Filed: May 22, 1985

[30] Foreign Application Priority Data

Jun. 8, 1984 [CH] Switzerland ..... 2799/84

[51] Int. Cl.[4] ..... D03D 37/00

[52] U.S. Cl. ..... 139/13 R

[58] Field of Search ..... 139/13 R, 13 A, 16, 139/188 R, 192

[56] References Cited

U.S. PATENT DOCUMENTS

| | | | |
|---|---|---|---|
| 881,169 | 3/1908 | Walter | 139/192 |
| 2,231,126 | 2/1941 | Kinsella | 139/13 R |

FOREIGN PATENT DOCUMENTS

| | | | |
|---|---|---|---|
| 2036813 | 7/1980 | United Kingdom | 139/13 A |
| 2052574 | 1/1981 | United Kingdom | 139/13 H |
| 2051149 | 1/1981 | United Kingdom | 139/13 A |

*Primary Examiner*—Henry S. Jaudon

*Attorney, Agent, or Firm*—Karl F. Ross; Herbert Dubno

[57] ABSTRACT

In the circular reed of the circular loom, a plurality of weaving shuttles circulate. Each weaving shuttle has rollers arranged in pairs at its top edge and its bottom edge. The rollers operate together with the corresponding gliding surfaces on the upper shuttle race or lower shuttle race of the circular reed, and each shuttle is supported to circulate on shuttle guide rods by the centrifugal force conveyed by the support elements. The shuttle guide rods of the circular reed define between them a slit in the region of the upper and the lower shuttle races, which slit receives upon opening of the travelling shed one of the warp threads of the upper shed or the lower shed, and form there an upper and a lower rollway, taking up the centrifugal force of the circulating weaving shuttle for the respective pairs of support rollers on the shuttle. The slit widens outside the rollways towards the reed-horizontal median plane to a warp-yarn crossing space. These measures permit a rapid increase of the rotational speed of the weaving shuttle and the utilization of larger warp yarn packages.

6 Claims, 8 Drawing Figures

FIG. 2
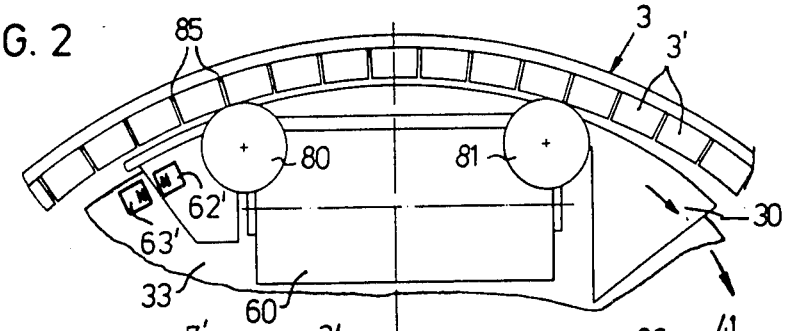
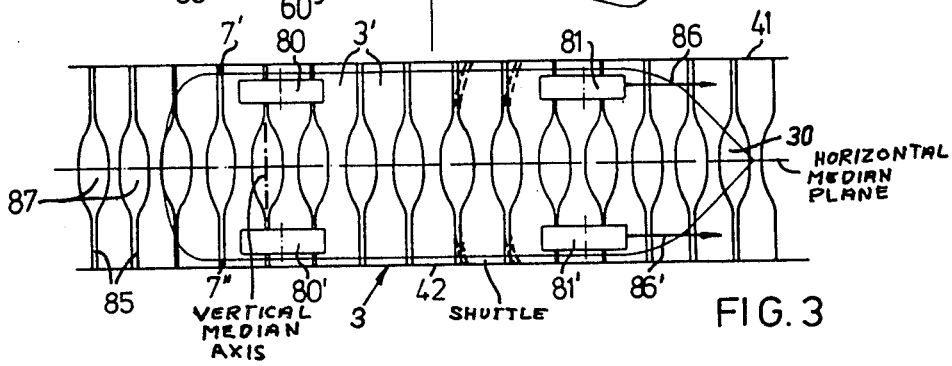
FIG. 3
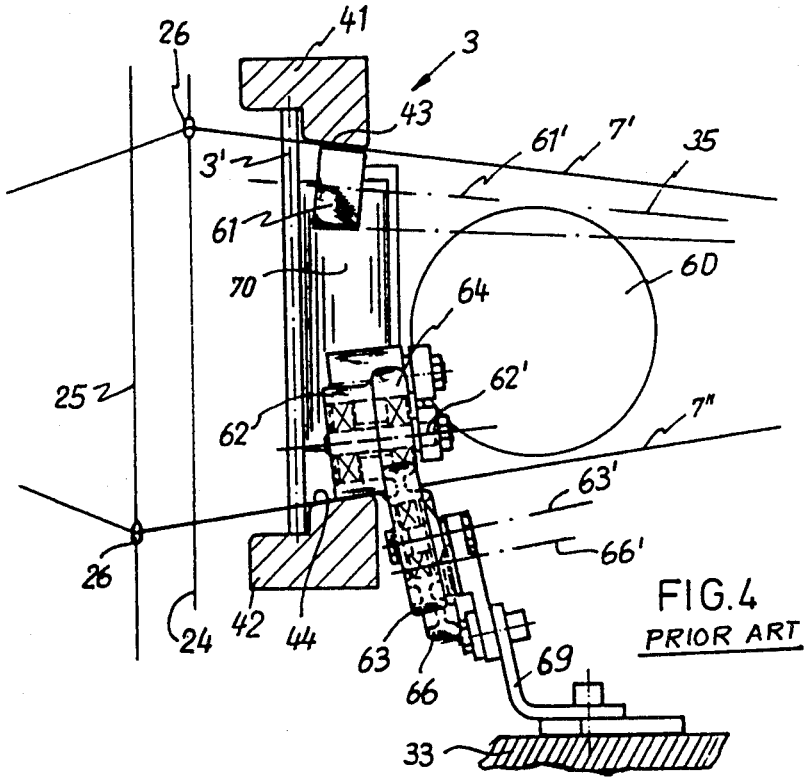
FIG. 4
PRIOR ART

CIRCULAR LOOM

FIELD OF THE INVENTION

The present invention relates to a circular loom, in the circular reed of which a plurality of weaving shuttles rotate, each weaving shuttle having rollers arranged in pairs on the top edge and bottom edge thereof. The rollers cooperate with the corresponding gliding surfaces on the upper shuttle race or lower shuttle race of the circular reed and each shuttle is supported so as to circulate on the shuttle guide rods by the centrifugal force delivered by the support elements.

BACKGROUND OF THE INVENTION

Hitherto-known circular looms comprise inner and outer partial healds which are arranged circularly in two rows round the circular reed of the loom and each have a plurality of inner and outer healds for the guidance of a part of the two systems of warp yarn distributed all round the reed, which, for the formation of the weaving or travelling shed, are given by way of the main shaft an up-and-down alternating motion in opposition. The weaving shuttles circulating in the circular reed deposit the weft thread which is unwound from the respective package carried along with the shuttle continually into the travelling shed.

In an effort to increase the productivity of such looms, it has been attempted both to increase the rotational speed of the weaving shuttle and to increase the volume of the weft thread package carried along by the shuttle.

However, owing to the additional weight and the increase in centrifugal force, the conventional kind of guidance of the weaving shuttle on the circular reed is strictly limited as can be seen from the heavy wear on the support means and an increased danger of damage to the warp yarn of the upper and lower sheds upon which the shuttle rolls.

OBJECT OF THE INVENTION

It is therefore an object of the present invention to provide a circular loom of the previously-mentiond type in such a manner that, while avoiding the drawbacks of the conventional arrangement, the output capacity of the loom can be increased through faster circulation of the shuttle and the utilization of larger weft thread packages.

SUMMARY OF THE INVENTION

This is accomplished according to invention in that the shuttle guide rods of the circular reed define between each other a slit in the region of the upper and the lower shuttle race, which slit receives upon opening of the travelling shed one of the respective warp threads of the upper shed or the lower shed, and forms an upper and a lower rollway, taking up the centrifugal force of the circulating weaving shuttle for respective pairs of support rollers on the shuttle, which slit widens outside the rollways towards the horizontal median plane of the reed to a web crossing space.

By these measures, it is possible for the first time to optimally fullfil both opposing requirements.

On the one hand it is possible to place the shuttle guide rods so tightly together that these may be rolled over with utmost quietness of running by the support rollers of the shuttles. On the other hand, I can space the shuttle guide rods apart sufficiently that the crossing warp threads pass by each other with as little touching as possible even at the greatest speed of shedding and, even when knots an thickenings are present in warp thread.

Further optimization can, moreover, be achieved when the shuttle guide rods form on their inner side, at least in the region forming the rollways, a cylinder surface, broken only by the slits, whereby it is possible that the slits, in relation to their vertical axle center, widen symmetrically or asymmetrically toward the web crossing space.

Furthermore, these measures permit according to invention, for the first time, quite considerable structural simplifications of the reed in that in the regions of the shuttle guide rods forming the upper or lower rollway the upper and lower shuttle raceways are formed in one piece change inward to conical members on which rod-shaped intermediate pieces sit, which define the web crossing space. Alternatively the circular reed, together with the upper and the lower shuttle race and the shuttle guide rods, can be formed as a one-piece cylinder-shaped annular body with openings provided for slits and web crossing spaces.

With the construction of the circular reed according to invention, and the optimal rolling conditions of the shuttles on the reed, it is possible to dispense with existing wear-intensive contact drives between the shuttle and rotating plate cam.

This is achieved in the circular loom according to invention, in that a pushing means revolving with the plate cam of the loom is provided for each weaving shuttle, the pushing means being in driving relation with the rear end in the direction of motion of the shuttle. The pushing means on the plate cam can comprise at least one permanent magnet with given polarity, which is operatively coupled with at least one permanent magnet of same polarity on the shuttle.

BRIEF DESCRIPTION OF THE DRAWING

In the drawing:

FIG. 2 is a partial sectional view of the circular loom according to FIG. 1, showing the weaving shuttle in perspective view and on a larger scale;

FIG. 3 is a partial sectional view from the inside of the circular reed of the circular loom according to FIG. 2, with the simplified weaving shuttle represented, on a larger scale;

FIG. 4 shows an arrangement similar to that of FIGS. 1 and 2 in cross section and in another form;

SPECIFIC DESCRIPTION

Figure 1:
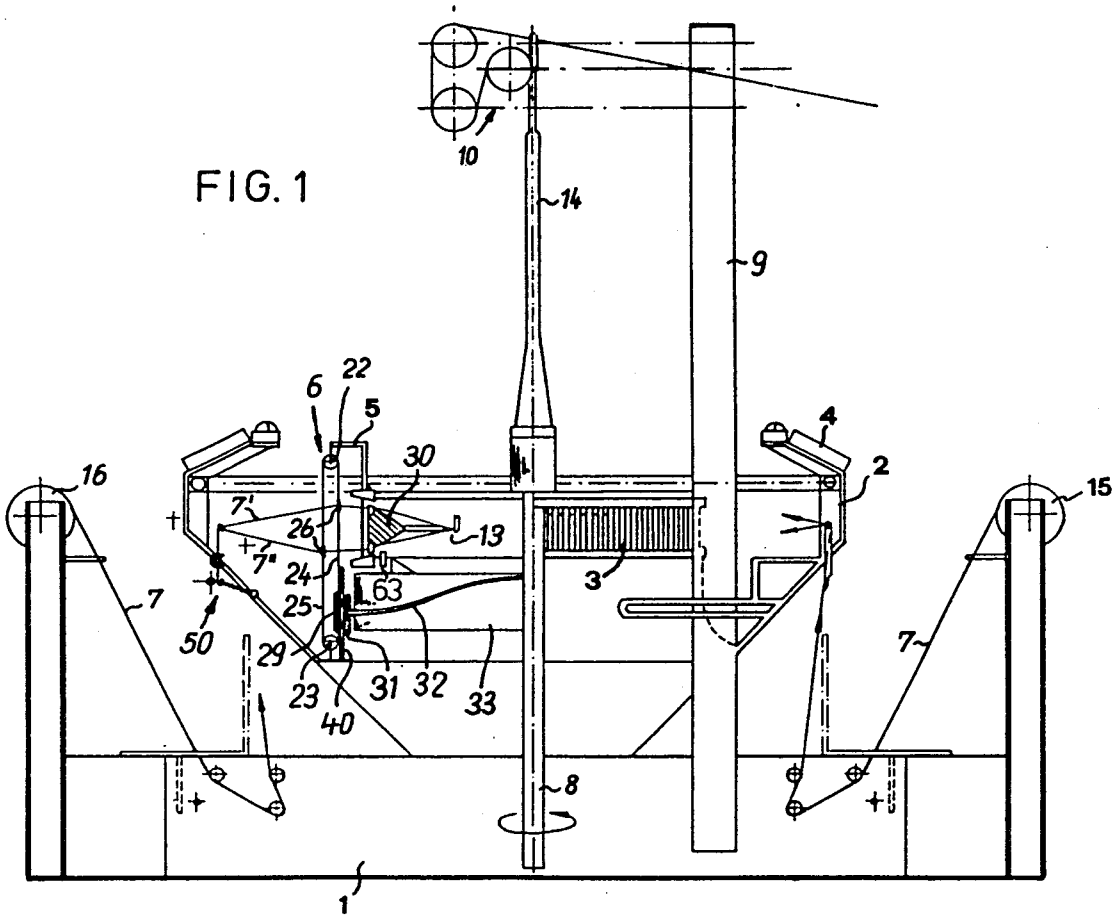
FIG. 1 is a schematic representation in side view of a circular loom.
Figure 5:
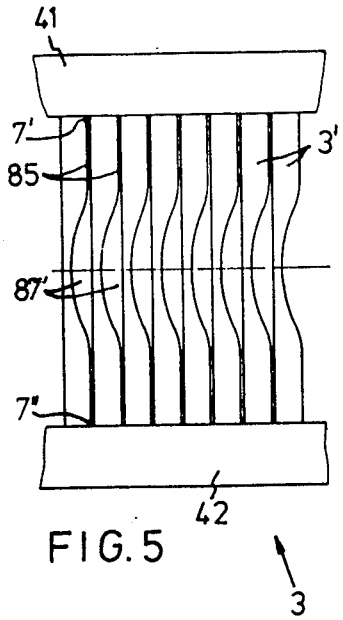
FIGS. 5 and 6 show further embodiments of the circular reed.

The circular loom according to FIG. 1 is mounted in the conventional way on a loom base 1, and comprises a circular frame carrier 2, which carries a circular reed 3, stop-start means 4 for the loom, and further frame members 5 for supporting the healds 6. These healds are arranged in known manner circularly round the main shaft 8 of the loom.

In addition, the support 9 carries the cloth drawing-off rollers 10, for the textile drawing-off device, and is mounted on the loom base 1. A cloth expander 14 is also disposed in the drawing-off area. Further, in the circular loom illustrated, it is also possible to see the feed rollers 15 for warp threads on the lefthand side and the feed rollers 16 for warp threads on the righthand side. These warp threads 7, whose path is only partly shown, are divided into two systems of yarn sheets, and are drawn off in the conventional way from groups of warp thread spools, which are not illustrated in greater detail here. For the formation of the weaving shed, one of these yarn sheets is lifted up while the other is guided down from the level of the weaving plane during the so-called change change-of-shed or shedding motion, so that a warp thread upper shed 7' and a warp thread lower shed 7'' result. In this travelling shed, at least one but as a rule several, shuttles 30 each with a bobbin of weft yarn 60 (FIG. 2) is circulated along a horizontal circular path. Owing to the circular motion of the shuttles, the pick wound off from the bobbin of weft yarn is transferred onto the edge of the tubular fabric 13 so that this shuttle thread can be woven into the fabric. The tubular fabric can then be drawn off and spread as a flat tubular fabric.

In order to produce the previously-mentioned change of shed, a plurality of healds 6 are arranged circularly round the main shaft 8 of the loom near the outer surface of the circular reed 3. As can be seen in FIG. 1, each heald 6 comprises, for example, partial healds 24 and 25 being formed by band strands. For example, an endless band can, for this purpose, be guided over each of the rotatably supported guide rollers 22 and 23 on the upper and lower parts of the frame 5.

The inner strand 24 and the outer strand 25 of the band each have yarn guiding eyes 26, through each of which a warp thread 7 of one or the other systems of yarn sheets 7' or 7'' is drawn. The opposing up-and-down alternating motion of the strands 24 and 25 of the band produces, then, the previously-mentioned change of shed motion on both systems of yarn sheets.

For this alternating motion, it is known that preferably the inner strand 24 is tightly connected below the yarn guiding eyes 26 with a so-called shuttle slide 29, which is slidable up and down on movement control means 40. Projecting from this vertical slide 29 are guide rollers 31, which are supported by way of a rotating plate cam 33 on a corresponding curved guide profile 32 and which is rotated by the main shaft 8 of the loom.

Furthermore, it is known that for the drive of each shuttle 30 through the weaving shed, a pushing means 63 for each rotating shuttle is arranged on the plate cam 33, and which cooperates with means on the rear end, in the direction of guide motion, of the respective shuttle to push the shuttle along in front of it.

To the extent described above, the circular loom represents the state of the art, so that further explanation of such a loom in unnecessary.

It is desirable to increase the rotational speed of such a loom and/or enable it to use heavier or larger weft thread packages while simultaneously reducting the strain on the warp threads, and limiting frictional heat and wear on the circular reed and on the rotating weaving shuttles.

For this, it has already been proposed by the same applicant, to equip, according to FIG. 4, each weaving shuttle 30 pairwise with rollers 61 or 62 on the top edge and bottom edge, which are supported on the corresponding gliding surfaces 43 or 44 on the upper shuttle race 41 or on the lower shuttle race 42 of the circular reed 3. In this connection, the arrangement of the rollers on the weaving shuttle 30 is such that the axes of rotation 61' and 62' of the upper roller 61 and the lower roller 62 on the weaving shuttle 30 define a cone-shaped surface 35, of which the apex is at least approximately in the area of the axis of rotation of of the loom or of the edge 13 of the textile (FIG. 1), the rollers 61 and 62 being each constructed in the form of a truncated cone, the apex of which coincides with the axis of rotation and whereby the gliding surface 43 or 44 of the upper resp. lower shuttle race 41 or 42 form a counter surface, which is equally inclined to the surface of the rollers 61 or 62.

Thus when the travelling shed is completely open according to FIG. 4, the warp threads 7' of the upper shed and the warp threads 7'' of the lower shed lie upon the opposing surfaces 43 or 44 on the upper or lower shuttle races 41 or 42, and have the same angle of inclination as that of the yarns meeting the textile at 13 (FIG. 1).

With this specified arrangement of rollers on the shuttles and the roller drive, it is not only possible to realize optimal rolling conditions, but also optimal conditions are created where the warp threads of the upper and lower sheds are rolled upon, which, despite substantially greater rotational speeds and larger or heavier weft yarn pages 60, substantially less thread breakage can be expected.

With increased rotational speeds, the relatively heavier shuttles 30 now create substantially greater centrifugal force on the shuttle guide rods or strips 3', defining the warp passages between them, hence, it is no longer sufficient for the shuttles to be supported in the usual manner by sliding runners on the shuttle guide rods 3'. In particular the sliding runners must be replaced by roller means. However, it is not sufficient, as shown in FIG. 4, merely to equip each shuttle with vertical rotational rollers 70 rolling on the shuttle guide rod 3'.

It requires, on the contrary, a completely new circular reed technology. On the one hand it is desirable to place the shuttle guide rods so closely together that these may be rolled over with utmost quietness of running by the support rollers of the shuttles. On the other hand, it is desirable space the shuttle guide rods so wide apart that the crossing warp threads can pass by each other with as little touching as possible, even at the greatest speed of the following change of shed, even when knots and thick parts are present in warp thread. According to invention, it is now possible to successfully satisfy both requirements optimally by, as may be clearly seen in particular in FIGS. 3, 5, 6 and 8, having the shuttle guide rods 3' of the circular reed 3 define between each other a slit 85 in the region of the upper 41 and the lower shuttle race 42, which slit receives, with the travelling shed open one of the respective warp threads of the upper shed 7' or the lower shed 7'', and forms there an upper and a lower rollway 86,86', taking up the centrifugal force of the circulating weaving shuttle 3, for the respective pairs of support rollers 80,80'; 81,81' on the shuttle, which slit 85 widens beyond the rollways 86,86' towards the reed-horizontal medium plane to a web crossing space 87.

Herewith, the shuttle guide rods 3' form on their inner side at least, in the region forming the rollways 86,86', a cylinder surface, broken only by the slits 85.

Figure 8:
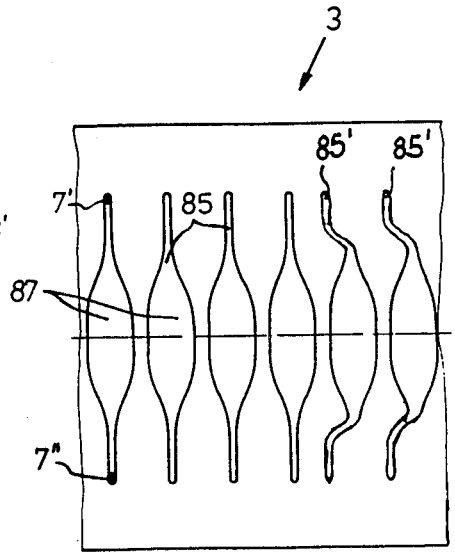

In order to increase the supporting contact of the shuttle rollers 80 and 81 or 80' and 81' on the shuttle guide rods 3' also in the region of the slits 85, such slits 85' can be at least partially inclined in the rotating circumferential direction (FIG. 8 right side).

Further, the slits 85, relative to their vertical median axis can widen symmetrically (FIGS. 3, 6 and 8) or asymmetrically (FIG. 5) to the warp crossing space 87 resp. 87'.

Figure 6:
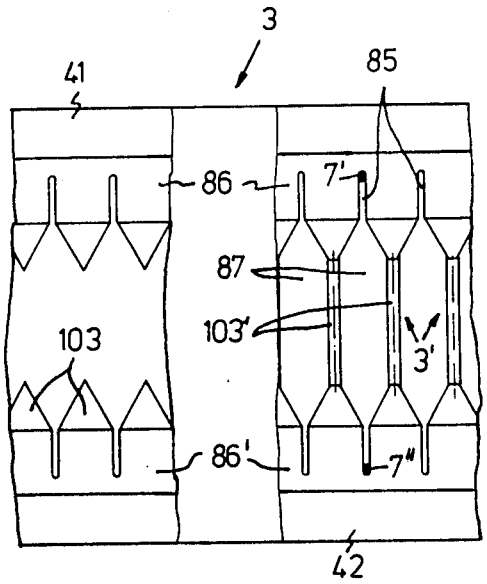
Figure 7:
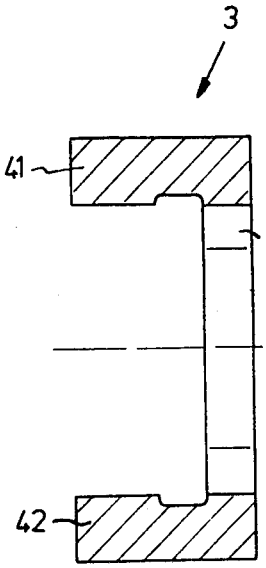
FIGS. 7 and 8 represent a further embodiment variant in cross section and in side view, respectively, of a circular reed of the circular loom according to FIG. 1.

As seen in FIG. 6, it is possible, for example, for the regions of the shuttle guide rods 3', forming the upper 86 and lower rollway 86', to be formed in one piece on the upper race 41 and the lower shuttle race 42, respectively and to change inwardly to conical members 103 on which rod-shaped intermediate pieces 103' sit, which define the web crossing space 87.

A still greater simplification of the reed arrangement can then be achieved when the circular reed 3, together with the upper 41 and the lower shuttle race 42 and the shuttle guide rods 3', is formed as a one-piece cylinder-shaped annular body with openings provided for slits 85 and web crossing spaces 87.

It is known that for the drive of the shuttle 30 through the weaving shed with the plate cam 33 (FIG. 1), one pushing roller 63 as provided per rotating shuttle, and is intended to cooperate with the lower rear roller 62 on the shuttle 30. The pushing roller 63 is supported in accordance with FIG. 4 by way of an approximately L-shaped bracket 69 on the plate cam of the weaving loom, whereby here the axis 63' of the pushing roller 63 extends at open shed approximately parallel with the extension of the lower-shed warp threads 7'', and, whereby, the surface of the pushing roller 63 is in engaging contact with, and suitable to roll on, the surface of a roller shoulder 64 of larger diameter on the pushing counter roller 62 of the shuttle 30.

Owing to the development of the circular reed according to invention, and the therewith attained optimal roll-off conditions of the shuttles on the reed, it is known, moreover, possible to dispense with the roll means, previously described with the aid of in particular FIG. 4, for the drive of the shuttles by the rotating plate cam 33. As has become apparent, the attained optimal roll-off conditions, due to the measures according to invention, permit the shuttles to be driven circularly around with the slightest feeding power, which is achieved according to invention by permanent magnet means. In the place of the complicated roller drive, only a permanent magnet 62', or a plurality of permanent magnets, with, for example, outer north-pole surface, in the place of the contact roller 62 of FIG. 4, can be arranged as shown in FIG. 2 at the rear end of each shuttle 30. The permanent magnet 62' cooperates with a permanent magnet 63' of the same polarity, which rotates with the plate cam 33 as a pushing element. This, pushing pemanent magnet 63, replaces the pushing roller 63, previously described with the aid of FIG. 4.

These measures provide, thereby, as may easily be seen, not only an essential simplification of the construction concept, but also reduce by a considerable amount the phenomena of wear and in particular the noise level.

What I claim is:

1. In a circular loom having a circular reed traversed by warp yarn to which a shedding motion is imparted and in which at least one weaving shuttle rotates in the reed, the improvement wherein said reed comprises:

an upper circular shuttle race, a lower circular shuttle race, and a multiplicity of strips extending between said races and defining between them guide passages equispaced around the reed and each accommodating two yarns which cross substantially at a horizontal median plane through said reed during shedding motion of said yarns, each of said passages comprising an upper and a lower narrow slit extending from said upper and said lower races respectively in the direction of said median plane and widening to join at said median plane whereby each of said narrow slits accommodates a respective yarn in the region of the respective race when a shed is formed and the widened portions of said passages at said median plane permit the yarns of said passage to cross past one another without interference during a shed changeover movement of said yarns at a warp crossing space; and said shuttle is provided with pairs of rollers respectively at a top edge for engagement with said upper race and at said bottom edge for engagement with said lower race whereby said rollers of said shuttle ride on said races as said shuttle is biased outwardly by centrifugal force, said slits extending below said upper and lower races to receive said yarns and recess them below respective surfaces of said races on which said rollers run.

2. The improvement defined in claim 1 wherein said strips form along the inner sides thereof in a region forming said races, a cylindrical surface interrupted only by said slits.

3. The improvement defined in claim 1 wherein said slits each widen toward said median plane symmetrically with respect to a vertical axis of the respective passage.

4. The improvement defined in claim 1 wherein said slits each widen toward said median plane asymmetrically with respect to a vertical axis of the respective passage.

5. The improvement defined in claim 1 wherein said reed with said races and said strips is formed as a one-piece cylinder-shaped annular body provided integrally with said passages.

6. The improvement defined in claim 1, further comprising means for displacing said shuttle including at least one permanent magnet displaceable along said reed, and a further permanent magnet in repelling relationship with the first-mentioned permanent magnet provided on said shuttle and a rearward end thereof with respect to the direction of shuttle movement in said reed.

* * * * *